US010059024B2

(12) United States Patent
Hood

(10) Patent No.: US 10,059,024 B2
(45) Date of Patent: Aug. 28, 2018

(54) POWER FEEDER AND FENCE FOR INVERTED ROUTERS

(71) Applicant: Dale T Hood, Wimberley, TX (US)

(72) Inventor: Dale T Hood, Wimberley, TX (US)

( * ) Notice: Subject to any disclaimer, the term of this patent is extended or adjusted under 35 U.S.C. 154(b) by 141 days.

(21) Appl. No.: 15/162,360

(22) Filed: May 23, 2016

(65) Prior Publication Data

US 2017/0036370 A1 Feb. 9, 2017

Related U.S. Application Data

(60) Provisional application No. 62/201,186, filed on Aug. 5, 2015, provisional application No. 62/306,386, filed on Mar. 10, 2016.

(51) Int. Cl.
*B27C 5/06* (2006.01)
*B27C 5/04* (2006.01)

(52) U.S. Cl.
CPC . *B27C 5/06* (2013.01); *B27C 5/04* (2013.01)

(58) Field of Classification Search
CPC .... B27C 5/02; B27C 5/04; B27C 5/06; B27C 1/12; B27B 25/02
USPC ..... 144/246.1, 246.2, 248.4, 248.5, 248.6, 144/248.7, 250.1, 250.11, 253.6
See application file for complete search history.

(56) References Cited

U.S. PATENT DOCUMENTS 3,854,614 A * 12/1974 Albrecht ..... B23Q 7/05 226/177
4,058,151 A * 11/1977 Yonezu ..... B27B 25/02 144/248.4
5,779,407 A 7/1998 Tucker
6,398,469 B1 6/2002 Bain
6,481,477 B1 11/2002 Szymanski
6,520,225 B1 * 2/2003 Dembicks ..... B27C 5/04 144/135.2
RE38,612 E 10/2004 Tucker
2014/0360627 A1 * 12/2014 Sung ..... B27B 25/02 144/248.4
2015/0321379 A1 * 11/2015 Hoover ..... B23D 55/046 144/376

OTHER PUBLICATIONS

Board Buddies Instruction manual, date unknown, Board Buddies available since before 2006.

* cited by examiner

*Primary Examiner* — Matthew G Katcoff
(74) *Attorney, Agent, or Firm* — Guy Cumberbatch

(57) ABSTRACT

An electrically powered work piece feeder for use with inverted routers or small shapers incorporates improvements in adjustability which enhances accuracy, convenience, and safety in the use of such power tools. The powered feeder element mounts on a table fence and has an inverted roller suspended over the table adjacent a working face. Mounting structure permits positional adjustment of the roller in spatial relation to the power tool cutter and a workpiece on the table so as to propel the workpiece on the table over the power tool cutter and along the working face in the direction of the longitudinal feed axis. An out-feed section may be provided on the fence that includes inner and outer wedge-shaped ramps movable with respect to one another along the longitudinal feed axis and adapted to be locked together, thus allowing slow and precise advancement of the outer ramp toward the router.

19 Claims, 6 Drawing Sheets

POWER FEEDER AND FENCE FOR INVERTED ROUTERS

RELATED APPLICATIONS

The present application claims priority under 35 U.S.C. § 119 to both U.S. Provisional Application No. 62/306,386, filed Mar. 10, 2016, and U.S. Provisional Application No. 62/201,186, filed Aug. 5, 2015, the contents of which are hereby expressly incorporated by reference.

FIELD OF THE INVENTION

The present application primarily addresses difficulties and safety issues encountered when work pieces of such small dimensions as to be difficult to grasp are desired to be shaped, trimmed, or otherwise processed with a tool, such as a woodworking router, which is mounted below a work surface, or router table, the cutter or other attachment projecting upward through the work surface.

BACKGROUND OF THE INVENTION

It is a common, if not pervasive, practice in the woodworking field to employ routers that are mounted under a work surface, or table-top, i.e., inverted, with the cutter projecting upward through an opening in said work surface to engage the work piece being processed. An inverted router is in essence a small shaper, and many shops large and small employ routers in this manner in the production of cabinet doors, mouldings, and many other products. In the case of curved or contoured work pieces, the process is executed without the use of a fence, relying on a guide bearing which is an integral part of the router bit. However, most work is done using a fence to limit the depth of engagement of the work piece into the bit. There are many suppliers of such fences, and many designs, usually marketed in conjunction with a router table as mentioned above.

In that this application includes a fence as a component of the total embodiment, the following U.S. Patents disclose fences by others: U.S. Pat. Nos. RE38612; 5,779,407; 6,398,469; and 6,481,477. Another exemplary fence of the prior art, the Kreg Precision 36" Router Table Fence, is seen as Item #148836 in the 2014 Edition of the Woodcraft Supply Catalog.

The referenced publications above, as well as many others, demonstrate embodiment of many meritorious features and innovations in the field of router table fences; however, the features and combinations of elements to be presented herein were found lacking, as will be made apparent in the following description and drawings.

SUMMARY OF THE INVENTION

This application presents a system for use with inverted routers or small shapers which incorporates an electrically powered work piece feeder component with a router table fence having improvements in adjustability which enhances accuracy, convenience, and safety in the use of such power tools. More generally, the powered work piece feeder may be used with a workpiece support fence mounted on a table having a power tool cutter projecting upward therefrom. The power tool cutter may be an inverted router, a shaper, a table saw, or even a band saw.

The fence has a working face above the table extending adjacent the power tool cutter to define a longitudinal feed axis. A powered feeder element is adapted to rigidly mount on the fence and has an inverted roller suspended over the table on the same side of the face as the power tool cutter. The powered feeder element has fence mounting structure permitting positional adjustment of the roller in spatial relation to the power tool cutter and a workpiece on the table. The powered feeder element is further configured to position the roller in contact with the workpiece and rotate the roller so as to transfer pressure and motion to and propel the workpiece on the table over the power tool cutter and along the longitudinal feed axis.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

Figure 1:
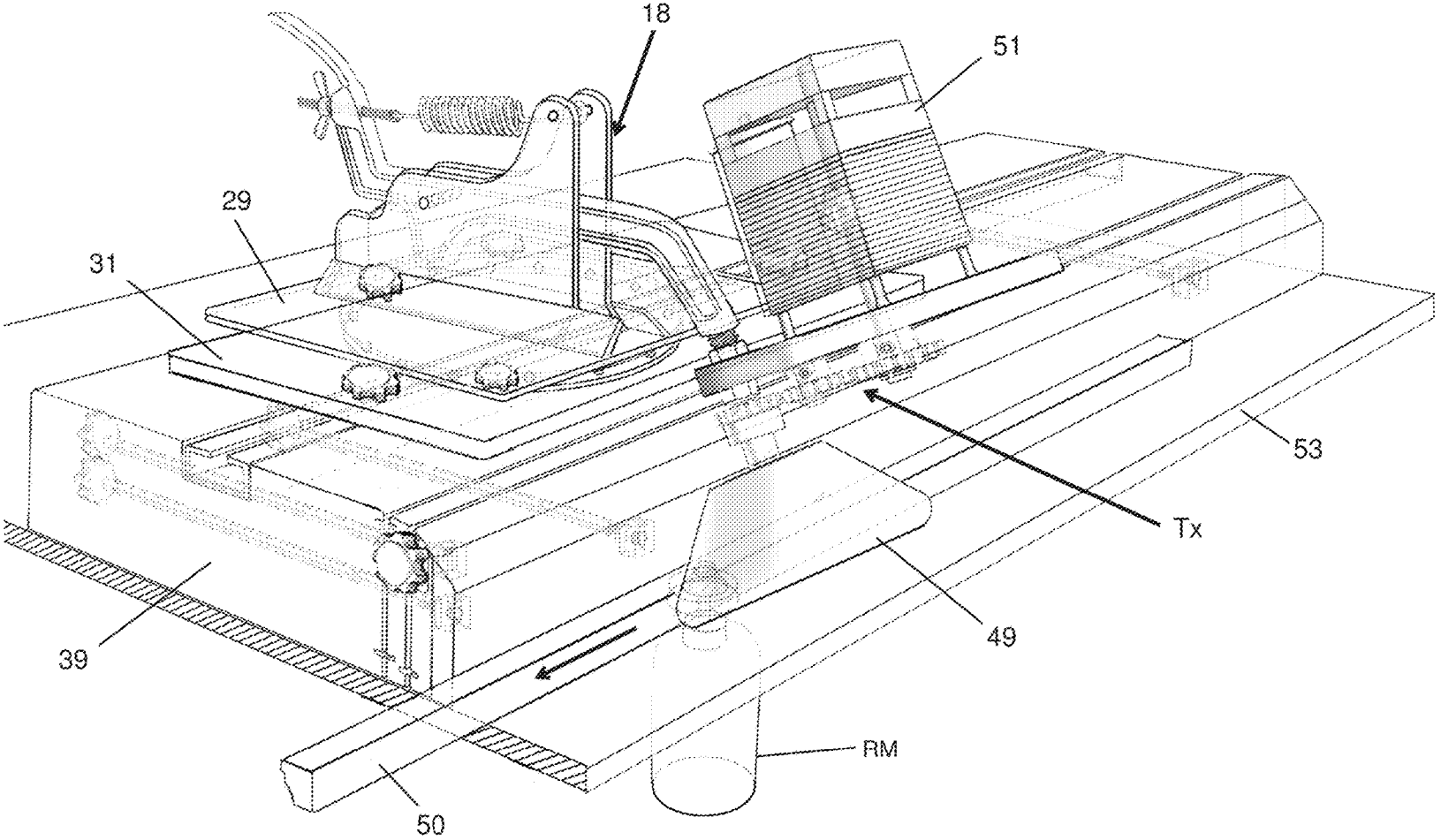
FIG. 1 is a perspective/isometric overview of a preferred embodiment of the complete fence-and-feeder system of the present application.

There are no examples in the art of a feeder mechanism incorporated into a router fence. The feeder element in the present application is perhaps the most outstanding aspect in this endeavor, and has apparently not been addressed before. The feeder element has been developed and conceived in response to the safety problem, and difficulty of work, related to use of the inverted router, especially when dealing with small work pieces. A built prototype deals suitably with this problem, producing excellent results and keeping the operator's hands well away from the cutters, and is represented in the drawings and description as the preferred embodiment of the feeder element. The fence herein described also has advantageous features regarding adjustability, safety, and convenience even if employed without its companion, the feeder element.

The following provide a glossary of terms used in reference to the drawings:

20. Pressure lever arm
21. Pressure adjustment screw
22. Pressure adjustment wing nut
23. Body of hold-down
24. Pressure spring
25. Pressure spring anchor roll pin
26. Lever arm fulcrum pin
27. Lateral adjustment base
28. Lateral adjustment locking knobs
29. Lateral adjustment base sub-plate
30. Rotary adjustment bearing
31. Rotary adjustment bearing sub-plate
32. Rotary adjustment locking knob(s)
33. Height adjustment screw
34. Height adjustment knob
35. Height adjustment lock nut
36. Fore-and-aft positioning track
37. Fore-and-aft positioning locking knob(s)
38. Fore-and-aft positioning locking knob nut
39. Main fence body
40. Drive component mounting nuts
41. Drive component mounting plate
42. Primary drive gear
43. Idler gear
44. Idler gear shaft
45. Idler gear snap ring (circlip)
46. Final driven gear
47. Final driven gear stop collar
48. Driven shaft
49. Feed roller, or tire
50. Work piece
51. Gearmotor component
52. Switch
53. Router table
54. Router bit
55. Sliding infeed fence
56. Infeed sacrificial face
57. Slotted plates
58. Sliding fence face locking screws
59. Sliding fence face locking knobs
60. Sliding fence face locking nuts
61. Inner outfeed ramp
62. Outer outfeed ramp
63. Outfeed sacrificial face
64. Outfeed ramp adjustment bracket
65. Outfeed ramp adjustment screw
66. Outfeed ramp adjustment knob
67. Sliding fence face alignment splines In broad terms the present application combines a router/small shaper fence which has improved adjustment features with a powered feeder which is especially adapted to extremely small work pieces, those work pieces being the ones that are most dangerous and most difficult to produce satisfactorily. But the use of the system here presented is not limited to the small work at all, providing efficiency, convenience, and safety when applied to larger work. When work is passed over the cutters of this type of tool by hand, as is now done almost exclusively, there is inevitably variation in feed speed and pressure, pauses occur when the hands of the operator are repositioned, and other inconsistencies arise which result in imperfect results.

The parts in the drawings and description here presented which are parts of said device are 20 through 28, and 33, 34, and 35, and 48 and 49. As seen most readily in FIG. 2, these parts provide a basic framework upon which to develop the system in the preferred embodiment here represented.

An example of the usefulness of the present system is in the production of a large amount of very small ¼-round moulding involved in a restoration job. The aforementioned hold-down on the router table fence was installed, as the square stock was too small to grip, and therefore impossible to feed across the fence. While providing sufficient holding pressure, the difficulty of feeding is not alleviated, and made still worse because the hold-down is in the way. Thus, the roller, or tire, of the device is motorized. Since the base of the hold-down is a single-position fixture, adjustment facility in other ways is also desirable.

One of skill in the art having basic skills of measuring and fabrication, and access to the necessary tools, can build this feeder apparatus, and the entire feeder-fence system, as shown here in a preferred embodiment.

Figure 2:
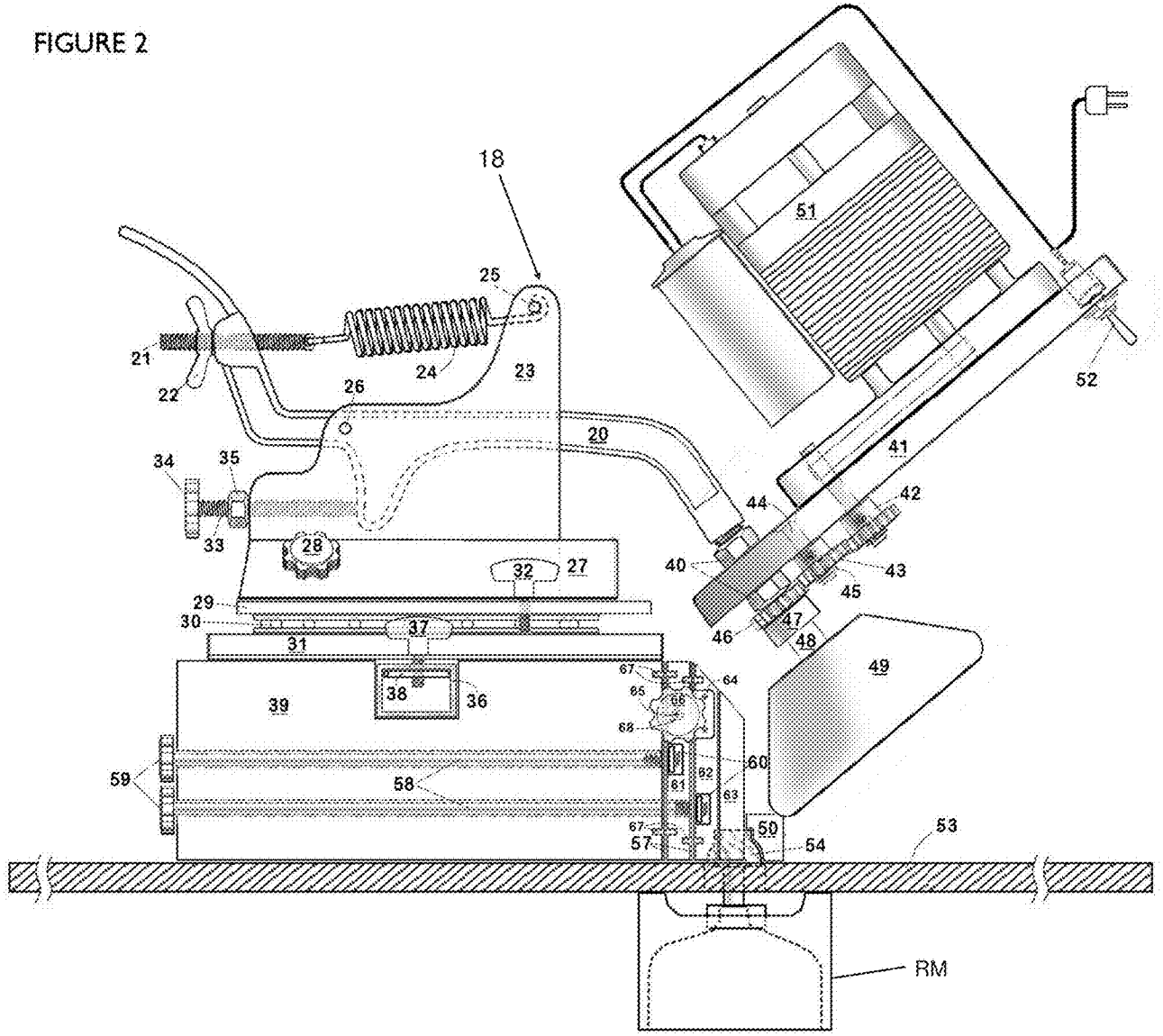
FIG. 2 is an elevation as viewed from the left, or out-feed, end of the system positioned on a work surface with a router bit projecting up through an opening in said surface and engaging the work piece.
Figure 3:
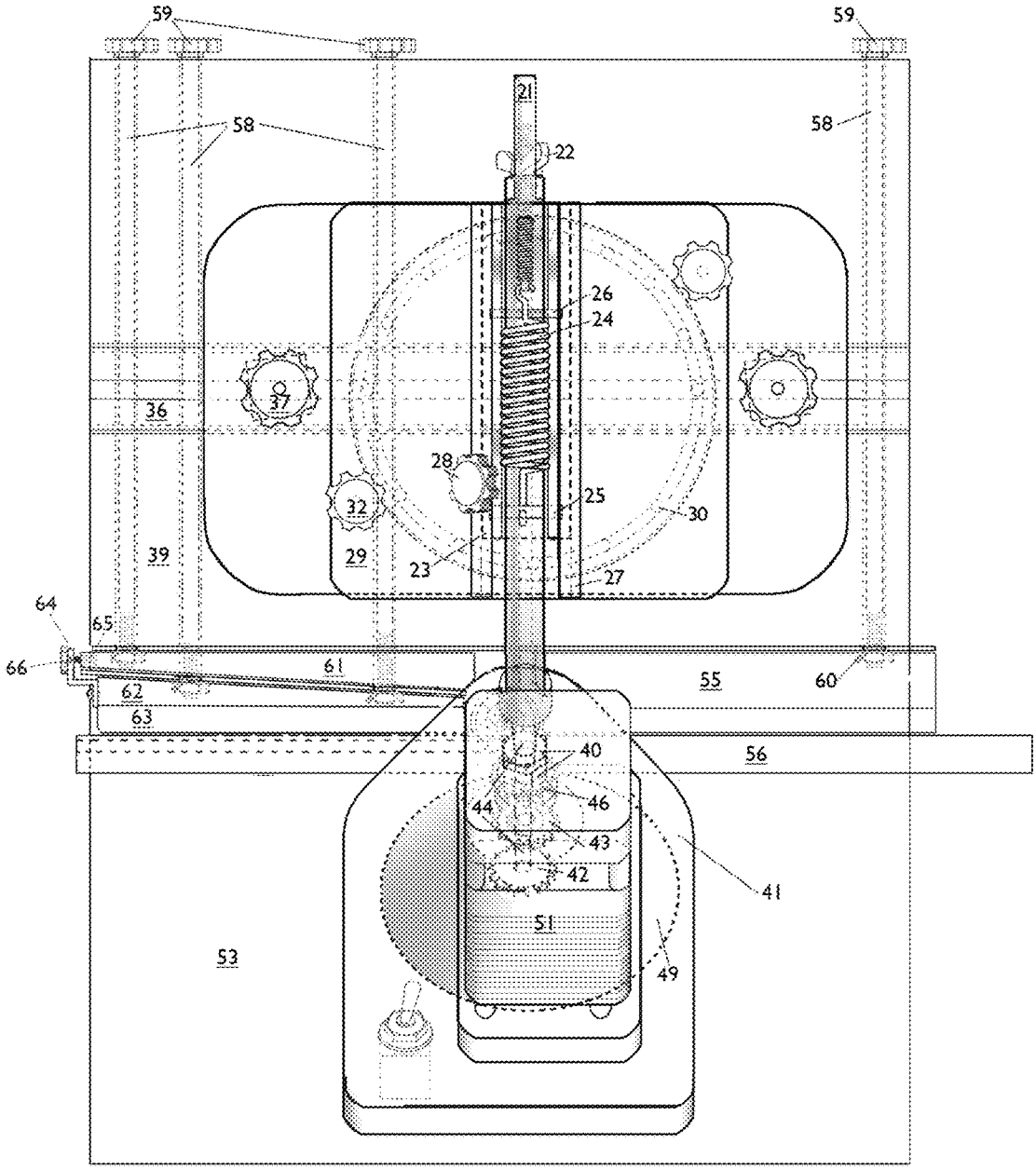
FIG. 3 is a top down plan view of the exemplary fence-and-feeder system, showing all components in neutral, "at rest" positions.
Figure 4:
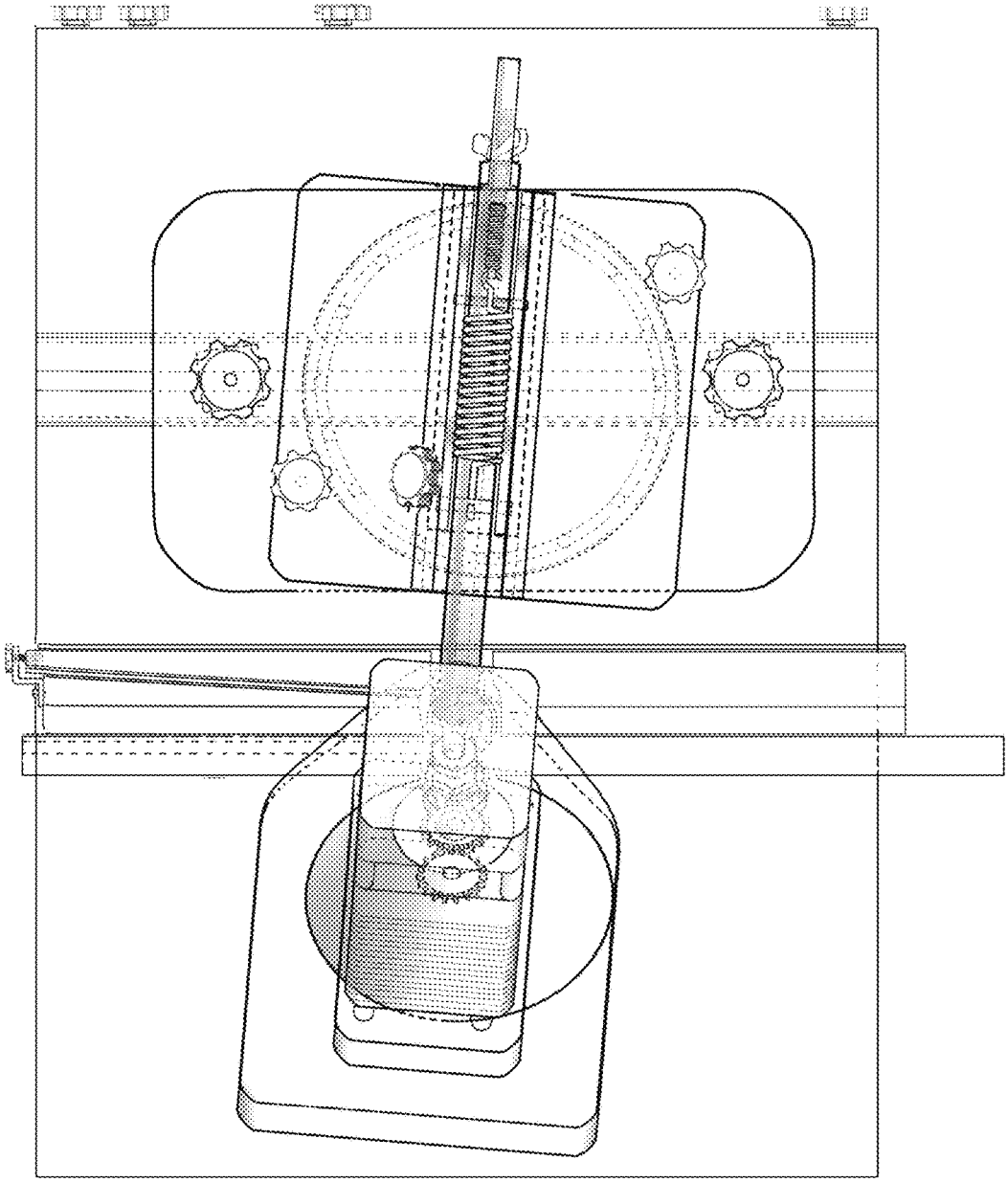
FIG. 4 is a variation of FIG. 3's plan view in the preferred embodiment of the application in operation position, provided to clarify the spatial relationships of the components and adjustability features, showing the feeder component slightly "crabbed" in relation to the fence body and work piece, as this is how it is used in practice.
Figure 6:
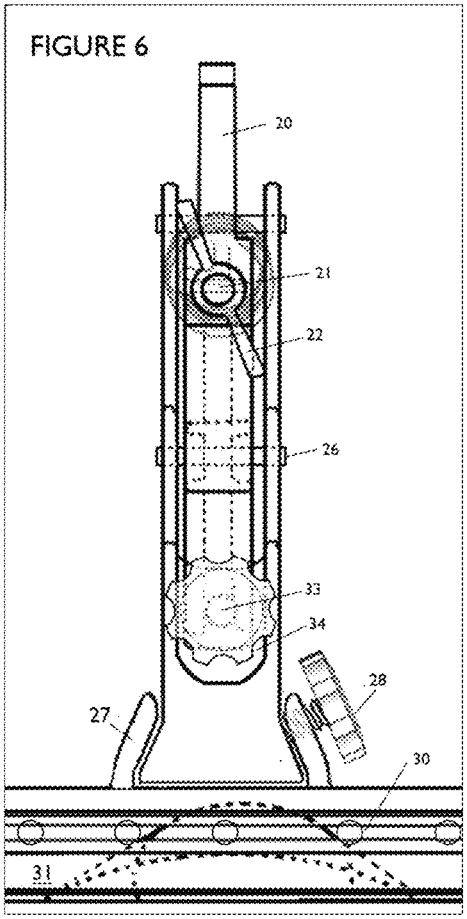
FIG. 6 is a close-up detail view of the same elevation in FIG. 5, showing more clearly the mini-feeder handle unit's components.
Figure 5:
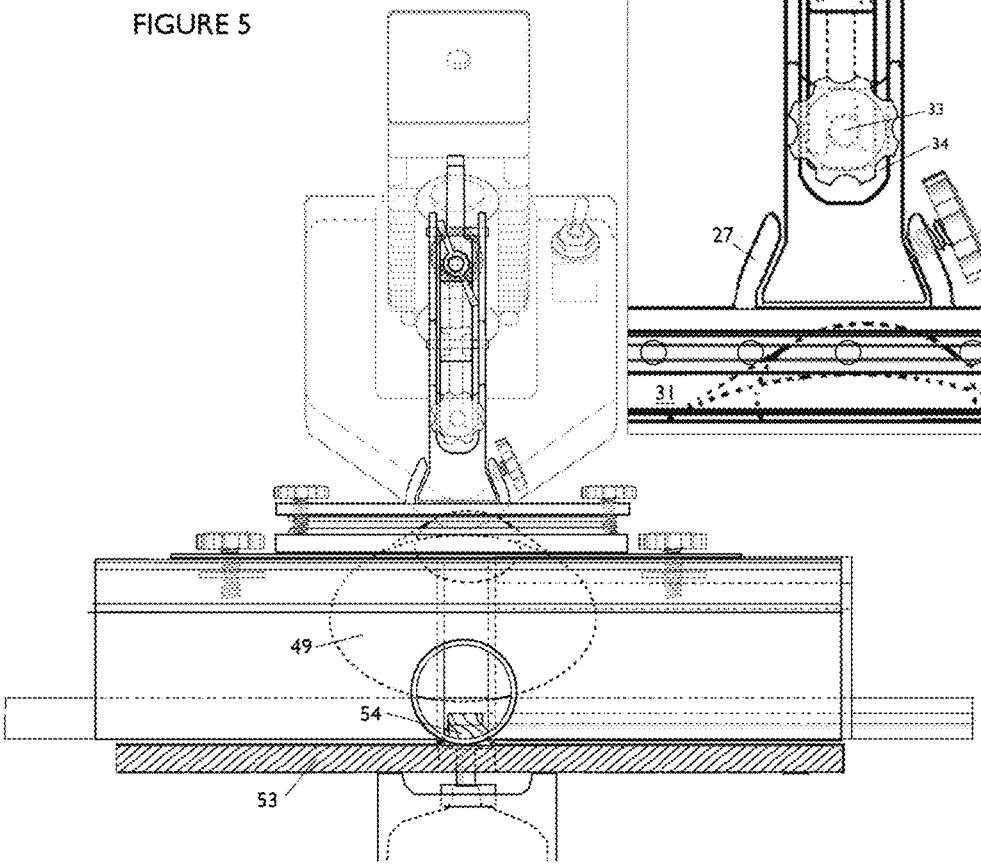
FIG. 5 is an elevation viewed from the rear, i.e., the side opposite the operator's normal position, provided to further clarify the adjustments to the feeder component.

As a first step the builder could cut the mounting plate 41 for the drive component (gearmotor) 51 FIG. 2, FIG. 3, and drill a clearance hole to slide onto the threaded portion of the roller shaft 48 where said shaft is screwed into the lower end of the pressure lever arm 20. This threaded section was provided by the hold-down manufacturer to allow adjustment of the length of said shaft. Two nuts 40 which fit these threads are employed to lock the mounting plate 41 firmly in a position perpendicular and away from the lever arm 20. Next, it is necessary to determine the position of the gearmotor, or drive component 51 in relation to the shaft 48, which is to be driven. The builder must obtain appropriate small spur gears, roughly 1" in diameter, with appropriate bores for use: The primary driven gear 42 must have a bore equal to the diameter of the output shaft of the gearmotor. A method of affixing to the output shaft must be used such as a keyway configuration. Otherwise the person skilled in the art could use a rollpin.

The final driven gear must be affixed to the driven shaft by keyway, roll pin, or other means, and as shown in FIG. 2, retained with a stop collar 47. As the tire, or roller, is in a free rotary state when manufactured, the hub of said roller must be affixed to its shaft. This was accomplished in the prototype by drilling through the stop collar and into the hub of the roller so as to allow the use of a roll pin. Now by careful measurement of the distances between centers of the gears being used when properly enmeshed, the relative positions of the three shaft centers can be determined. These drive units are consistently provided with threaded mounting holes.

Appropriate holes drilled in the mounting plate 41 will allow secure attachment of the gear-motor to the mounting plate 41. A hole must be drilled in the mounting plate for interference fit of the idler gear's shaft 44, which is pressed in. A person skilled in the art will readily see that it is best to establish the idler gear position relative to the final driven assembly first, then establish the position of the gear-motor.

The drive component 51 utilized in the prototype, represented here as a preferred embodiment, was selected by estimating the desired rate of feed, that being a moderate, if not conservative, proven approximate rate of 12-15 feet per minute.

By some simple calculations integrating the circumference of the roller at its outer edge the desired rpm of the roller 49 was determined to be about 15-20 rpm.

For simplicity the decision was made to transfer the rotational force of the gear-motor 51 through a series of spur gears 42, 43, 46 in which the primary drive gear 42 was identical to the final driven gear 46, allowing the selection of a gear-motor 51 with an output rpm within the desired range. The idler gear 43 is present to obtain clearance between components, and is provided with a simple shaft 44 pressed into the mounting plate 41, said shaft 44 having been machined to provide a groove to receive a snap ring, or circlip 45, to retain the idler gear. The gear-motor 51 used in the prototype was thus selected from the Grainger's catalog. One was chosen of an appropriate size and amperage for this application, and with a reversible feature, for reasons which will be explained.

The particular unit used in the prototype is catalog #4Z455 on page 108 in catalog 404 at Grainger's. It has an output rpm of 18, requires capacitor cat. #2MDV3, and has 1/100 hp. input. Although 1/100 hp. sounds very small, at the gear ratio 173:1, tests indicate it is very difficult to cause a stall in practice. This gearmotor includes a built-in brake, as these are commonly used in motion control situations; the brake has occasionally caused trouble in starting, and it would be preferred to locate a similar unit sans brake. An added bonus would be a gearmotor which was also of variable speed. Clearly a more powerful unit could be incorporated, as long as the bulk and scale of the component was appropriate in relation to the other elements.

The roller 49 shown is exemplary only and various types are contemplated. For instance, an existing static hold-down, or work piece guide, is marketed under the name Board Buddies™. It will be observed that the conical form of the roller on this device is useful in that it facilitates the positioning of the point of pressure into a very narrow corner where the table and fence meet. The roller 49 is desirably formed of an elastomer of various densities depending on the workpiece and power tool being used. In a preferred embodiment the roller 49 is formed of an elastomer of 50 durometer rating, most often employed in the industry for smooth workpieces. A denser roller may be used for rougher workpieces.

It will be obvious that this preferred embodiment could be made more sophisticated in the interest of durability and other qualities; such as cosmetic appearance, and that various methods of assembly could be employed to achieve the same purposes. The exemplary embodiment represents production of a working prototype while minimizing expense. Also, various methods could be employed for the transference of rotary force to the driven roller 49, roller chain and sprockets, for instance, these possibilities not detracting from the novelty or function of the invention nor avoiding infringement on the claims to follow.

Once the builder has combined the gear train, driven shaft and roller, it only remains to do some simple wiring, including a 3 pole switch 52, mounted in a convenient place, and a powered roller has been established on the lower end of the pressure lever arm 20.

Now our builder can move to the area where the hold-down's base 27 is attached to the rotationally adjustable platform, which is subsequently mounted to the main sub-plate 31, which in turn is slidable along the track 36 on top of the fence. Here 3 components are involved: The sub-plate 29 below the base 27, which is attached to the underside of the base by the use of short flat head machine screws through the sub-plate threaded into tapped holes in the hold-down base. Likewise the upper part of the rotary bearing 30 is attached to the underside of the sub-plate, and the lower part of the rotary bearing to the rotary adjustment bearing sub-plate. Prior to final assembly of the rotary element, the builder should do some drilling and tapping to accommodate the rotary adjustment locking knobs 32, which simply press down onto the rotary adjustment sub-plate 31, and clearance holes for the locking knobs 37 that engage nuts 38 trapped in the fore-and-aft positioning track 36, which is firmly embedded in the main fence body 39.

It should be mentioned for clarity that in this text "fore-and-aft" adjustment refers to the movement of the rotary bearing sub-plate along the longitudinal axis of the fence, and "lateral" adjustment refers to the movement available between the hold-down's body 23 and the hold-down's base 27. These terms were adopted because the elevation FIG. 2 is a view from the left end in relation to the operator's position, and this drawing is most easily understood regarding these features. Upon assembly of the elements discussed above the builder has created a motorized hold-down that can be adjusted to suit the task at hand, positioning the roller's height from the table, its distance from the fence, its angle of attack on the work piece, and it's position along the fence. These features avail the operator of versatile and precise set-up options to optimize his safety and the quality of results.

Once again, certain features and elements represented in this preferred embodiment could be altered. For instance, the rotary adjustment could be provided by simply allowing two plates in a rotatable relation to face each other, eliminating the bearing 30. This would result in a less satisfactory assembly, fabrication difficulties, and shorter durability. Under any circumstances, such omissions or alterations do not detract from the innovation of the invention, or its function, nor would such alterations avoid infringement of the claims to follow, no more than changing, say, a roll pin to a bolt, or the pitch of threads of a screw.

Now this description and our person skilled in the art can move down to the fence itself, upon which the feeder assembly rests and slides fore and aft. The fence and its parts and function will be discussed and described exclusively here to allow the reader, or person skilled in the art, to focus on the advantages and assembly of said fence until, as it were, it is ready to receive the powered feeder element and "go to work".

The building of the fence begins with its main body 39, which must be substantially robust in dimensions and stability to provide means of mounting to the router table, of which there are many, and ample room for various grooves and holes essential to the introduction of other parts. In this preferred embodiment illustrated and discussed it will be assumed to be made of a suitably stable and strong hardwood blank, likely of one of the exotic species known for strength, durability, and stability, for instance Ipe or Cumaru. Fabricating with wood lends itself to ease of machining for our builder skilled in the art having limited means or access to tools. Clearly metallic or even man-made materials could be used so long as the desired configuration could be produced.

This main body 39 will need a cross-section of approximately 2" in height×4" in width (50 mm.×100 mm.) and a length of about 2½ feet (75 cm.). This length is about normal, as is appropriate for use on ordinary sized router tables. As readily seen, the location of the opening for dust extraction, and thus the relation to the router bit itself, is determined by the particular table in use. This issue is related to the method, or means, of attachment of the entire assembly to the router table, which will be left open to the many options to be developed, and those methods already revealed in prior art. One exemplary method of fence attachment is a version of what is commonly called a "T-square fence", such as fence model PRS 1015 sold by the Kreg Company, Huxley, Iowa.

Perhaps our builder wishes to proceed first with the provision of a recessed channel which receives the track 36 along which the feeder assembly travels. These tracks are readily available from many sources and typically require a channel ¾" wide and (various) ⅝" deep. They are designed to accommodate companion locking knobs threaded into a trapped ¼"/20 pitch nut. Thus the feeder system's fore-and-aft adjustment would employ this conventional hardware.

This track will also accommodate the use of various accessories such as finger-boards and stops, and could be equipped with two feeder assemblies, one at in-feed and one at out-feed.

Next we come to the adjustable in-feed and out-feed fence faces that together form a working face against which the workpiece abuts. As illustrated in the plan view of FIG. 3, the in-feed section, to the right hand of the operator, is a separate part which is able to slide fore and aft along the main fence body, and is locked into position by the tightening of two knobs whose screws extend through the main fence body from behind. This feature allows the in-feed section, or face, to be retracted away from, or advanced toward the router bit. The alignment in relation to the main body is retained by splines 67 similar to those seen in the out-feed section in FIG. 2.

Also shown on both in-feed and out-feed faces are sacrificial auxiliary faces. These are made of any plausible material and easily replaced by the operator. The point of these sacrificial parts is that they can be advanced right up to the router bit, even being machined by said bit, to obtain "zero clearance" at the cutter's exposure. This condition in use provides reduced chipping, better dust removal, and prevents a work piece from entering the gap. These sacrificial surfaces could be provided with any sort of quick-change conveniences, made of fancy materials, and provided as consumables, or simply screwed onto the fence sections by the owner. Often in shaper and router work it is necessary to fabricate a receiver piece to be attached to the out-feed section which fits the profile being cut, to prevent rolling or other problems as the work piece emerges from the shaping operation at the cutter. Therefore the sacrificial face of the out-feed section is often modified, and regarded as a disposable part. In practice ½" plywood known in the trade as "Baltic birch" is quite suitable. The sacrificial contact faces are secured to the face of the fence so as to be easily removed or replaced, e.g. with Dzus fasteners.

Figure 7:
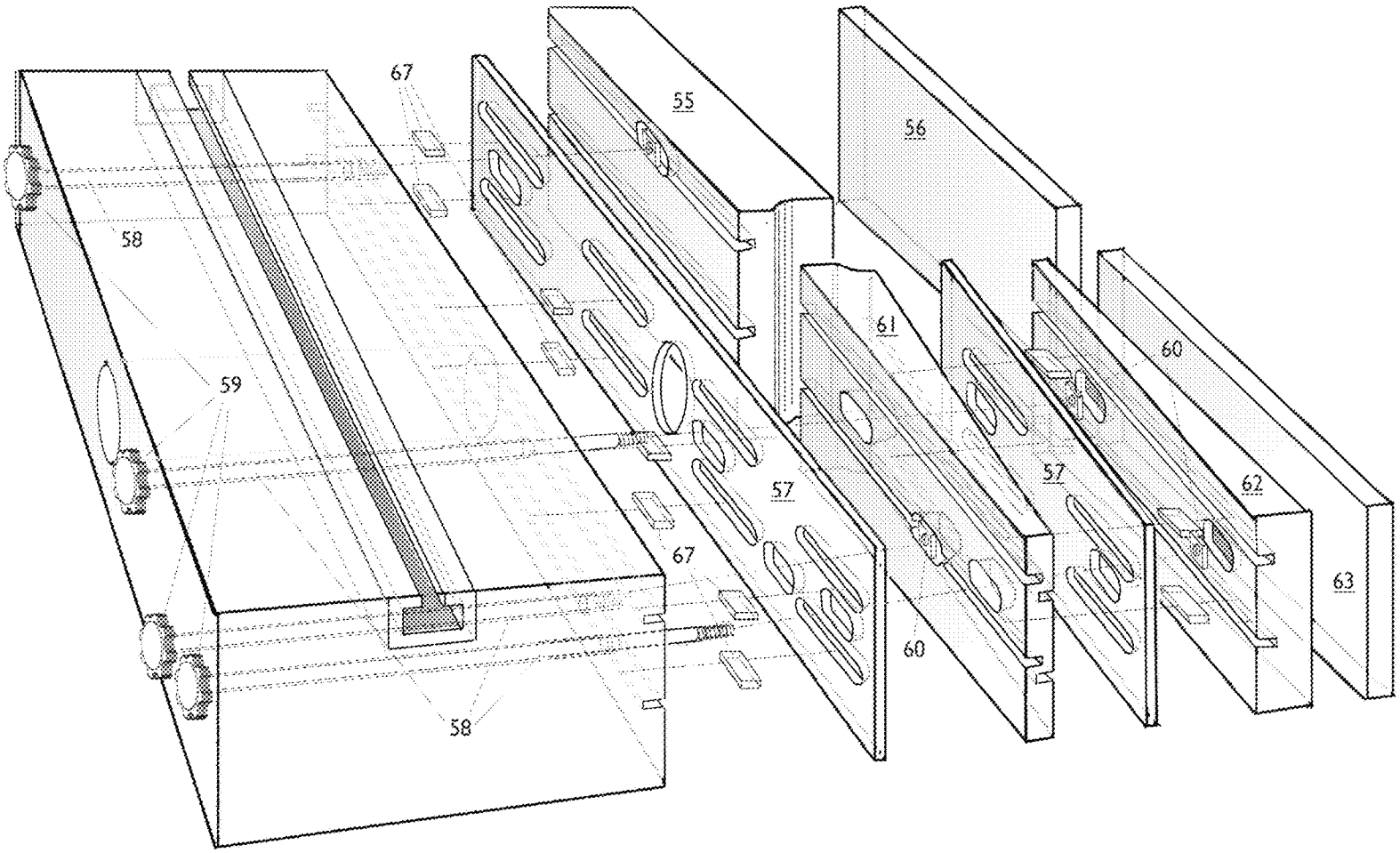
FIG. 7 is an exploded view of the interior mechanics of one embodiment of a functional in and out feeder ramp assembly required for safe and smooth operation of the mini-feeder. Other ramps, either commercial or custom made, may be used, alternatively to this customized variation, to insure straight motion of the feed stock both before (in) and after (out) router cutting operations.

Now if we proceed to the out-feed section with its sacrificial face 63, our builder will observe in FIG. 3, in plan, that this out-feed section is comprised of two wedge-shaped parts, or ramps, inner ramp 61 and outer ramp 62, which are again aligned with splines 67, and locked together with knobs from behind. FIG. 7 shows the inner ramp 61 and outer ramp 62 and the locking knobs 59 on the face of the fence opposite the working face against which the workpiece abuts. In FIG. 2, elevation, is illustrated a ramp adjustment bracket 64 attached to the outer ramp 62, and provided with an adjustment screw 65 and knob 66, which threads into the end of inner ramp 61, thus allowing slow and precise advancement of the outer ramp toward the router which results in moving the plane of the outfeed section forward, i.e., toward the operator. When the desired position is achieved, the ramps are locked together by knobs in the back, just as the two fence sections are.

Half of Fence Moves

This feature allows the operator to advance the outfeed fence face forward relative to the infeed, while not losing parallelism. This is often a desired setting, such as when the router is used as a jointer. The ramp system provides a highly accurate and positive "fine tuning" capability of infinite calibration, and has not been found in prior art. In a preferred embodiment, the ramp adjustment screw, with its knob, passes through a snug clearance hole in the bracket, then through a well-fitting "wave washer," sometimes called a Belleville, through another washer, all being held tight with a snap ring, or stop nut, the wave washer being in a slightly compressed state. Perhaps the most thoughtfully developed fences are from the Kreg Co., and even these developers have failed to provide this infinitely-adjustable outfeed feature, relying on the use of spacers or shims of definite dimension for this operation.

To build the fence's two sliding face assemblies, the builder will observe in the exploded view of FIG. 7, that the back side of each part has been provided with a plate of rigid material, preferably a good grade of aluminum, of the same dimensions as the face parts, except in thickness. An appropriate thickness which is readily available is ⅛".

These plates are introduced to form in essence a track which is trapping the lock nuts 60 which are engaged with the locking screws 58 and knobs 59, the nuts sliding along in a slot milled into the fence parts. This approach was assumed to avoid the bulk of most readily available tracks, as the ramp sections preferably are not bulky themselves. These plates will necessarily be slotted, like a track, for some distance along their length, to allow the fore and aft adjustment.

They will also be slotted in strategic areas to allow the insertion of the splines 67 which maintain alignment between parts. The splines can be conveniently supplied by using common keystock, the grooves to receive them being milled out on a table saw. The plates can be screwed to their respective components, the ramps and fence sections, or attached with epoxy. The locking screws that pass through the main fence body should do so in a relatively tight bore to prevent irritating bind-up. For better ergonomic relationship, a flat washer and a wave washer, or Belleville, should be under the knobs of the locking screws. An enhancement here would be the sleeving of said bores to eliminate the tendency of the locking screws to wear away the bores.

With these sub-assemblies made ready, the entire fence can be assembled, basically a stacking of the parts and threading of the locking screws into the trapped nuts. The fence can be affixed to the router table by clamps or other means, and the feeder assembly attached to its track. Now our operator has the facility to position the fence in relation to the router bit, then position the feeder roller precisely where desired, according to the size of work piece. The height of the roller, controlled by the height adjustment screw 33, is to be set so that the work piece can be nudged into the gap between the roller and the table, at which moment it begins to be fed. The angle of attack, or bias, some say "crab", is set at about 5-10 degrees, to ensure the roller is urging the work piece toward the fence. By sliding the feeder assembly along its track, the roller is set very near the opening in the fence, but avoiding contact with the router bit (!) and production can begin.

In operation, the material which is to be machined into a final product is first dimensioned and laid by for the operator to access conveniently in the work area. The entire fence is positioned over the router bit, allowing the desired amount of bit, or cutter, to protrude forward of the fence. Of course the height of the bit has also been adjusted in protrusion through the opening in the table. These settings are likely to have been estimated and may require adjustment once a first work piece has been milled. A first work piece is brought to the router table against the in-feed fence, allowing the operator to move the feeder assembly into its desired relation to the work piece, as discussed above.

The feeder and the router can now be turned on and the end of the work piece nudged into engagement with the roller, under the roller and against the in-feed fence. Said workpiece will advance over the cutter, material will be removed, and the finished product will continue onto the out-feed side. If in the milling process some of the entire height of the work piece has been removed, the operator will utilize the adjustment feature whereby he can advance the out-feed section of the fence to the point where the new surface of the workpiece is in contact with the out-feed section. He may also wish to slide both fence sections toward the cutter to minimize the clearance, as was previously discussed. With very little practice regarding setting up, perfect results can be produced, while the hands of the operator are never in close proximity to the cutter.

As is the case with any power tool, the operator must at all times exercise caution, ensuring that the machines are firmly affixed, the work area is uncluttered, and that loose clothing such as shirt-tails and sleeves are not in proximity to the action of the machines. The prototype in this preferred embodiment was equipped with a shroud over the gearmotor and another was placed over the geartrain. These shrouds are not shown in the drawings.

A second embodiment is also presented which concerns the unification of the two major elements, the fence as a whole as already described, and the feeder assembly. Where in the preceding description the feeder assembly is mounted to its track 36 which is embedded in the main fence body, and said feeder assembly has a rotary adjustment platform, an alternative embodiment could also prove effective in providing the same advantages of adjustability and versatility. In this second embodiment, the rotary adjustment element 30, 31 below the lateral adjustment base 27 are eliminated, and the plate beneath the lateral adjustment base is increased in size to provide ample space to accommodate installation of two switchable magnets, substantially on each side of and in close proximity to said base.

These small but powerful magnets are contained in a sleeve made of non-magnetic material, say aluminum or phenolic board, and carried loosely within the sleeves with machine screws that pass through the sleeves and into the body of the magnet. The sleeves themselves are firmly attached to the plate upon which the base is mounted. An opening beneath each magnet is cut in the enlarged plate slightly larger than the magnet itself. These remarkable rare earth magnets are available from the Magswitch™ Company of Westminster, Colo. The version to be used here is Magsquare 150, sku 8100054, which has a holding force of 150 pounds in contact with substantial ferrous material.

Now a steel plate of the same width and length as the main fence body, in thickness ⅛", or 3 mm, is attached firmly to the main fence body, say with countersunk wood screws. In this embodiment the operator positions the feeder assembly to his desire in relation to the router bit and switches the 2 magnets on. This second embodiment would provide all the advantages of the first embodiment in regard to the positioning of the roller, although perhaps with a bit less feeling of control. Though this version has not been prototyped, previous experience indicates the magnet strength to be more than adequate.

In summary, herein has been described and illustrated a fence system for use with inverted routers or small shapers which incorporates improvements in adjustability over prior art, and combines the fence with a feeder element designed specifically for use with such machines, having characteristics especially advantageous for use with work pieces of small dimensions, thus greatly enhancing operator safety and product quality.

While the invention has been described in its preferred embodiments, it is to be understood that the words which have been used are words of description and not of limitation. Therefore, changes may be made within the appended claims without departing from the true scope of the invention.

What is claimed is:

1. A workpiece feeder system for use with a workpiece support fence having a main fence body mounted on a table having a power tool cutter projecting upward therefrom, the main fence body fence having a working face above the table extending adjacent the power tool cutter to define a longitudinal feed axis, comprising:

a powered feeder element having a motor and drive shaft terminating in an inverted roller suspended over the table adjacent the working face, the powered feeder element having fence mounting structure including a base assembly configured to rigidly mount on top of the main fence body such that the drive shaft is suspended at a downward angle above and beyond the working face, the fence mounting structure permitting positional adjustment of the roller in spatial relation to the power tool cutter and a workpiece on the table, and the powered feeder element configured to position the roller in contact with the workpiece and rotate the roller so as to transfer pressure and motion to and propel the workpiece on the table over the power tool cutter and along the working face in the direction of the longitudinal feed axis, wherein the fence mounting structure includes a rotary adjustment assembly permitting rotation and securement of the base assembly about a vertical axis where the table is in a horizontal axis, wherein rotation and securement of the base assembly is capable of positioning a vertical plane through the drive shaft at an angle other than 90° relative to the working face and thus changes the angle of attack of the inverted roller against the workpiece and creates a bias therebetween that urges the workpiece against the working face.

2. The system of claim 1, wherein the roller has a conical shape to enable the pressure and motion to be applied to the workpiece adjacent the intersection of main fence body and table.

3. The system of claim 1, wherein the roller is an elastomer.

4. The system of claim 1, wherein the fence mounting structure of the powered feeder element includes an adjustable carriage for longitudinal feed axis travel along the main fence body.

5. The system of claim 1, wherein the base assembly includes a base mounted to a main sub-plate attached to the main fence body and a rotary bearing between the base and main sub-plate along with at least one threaded locking knob cooperating therebetween and enabling rotation and securement of the base about the vertical axis.

6. The system of claim 1, wherein the powered feeder element has a reversible gear motor to enable rotation of the roller to propel the workpiece on the table in the both directions along the longitudinal feed axis.

7. The system of claim 1, further including a pressure lever arm mounted to pivot about a horizontal axis on the base assembly and from which the motor and shaft are suspended, and a spring engaged between the pressure lever arm and the base assembly that translates into downward force to the inverted roller against the workpiece.

8. The system of claim 7, wherein a force exerted by the spring is adjustable by displacing a pressure adjustment screw attached to one end of the spring.

9. The system of claim 7, further including a height adjustment mechanism for raising and lowering the pressure lever arm, including a height adjustment screw that contacts the pressure lever arm and is rotated by a height adjustment knob.

10. A workpiece feeder system for use with a workpiece support fence mounted on a table having a power tool cutter projecting upward therefrom, comprising:

a workpiece support fence having a main fence body mounted on the table, the main fence body having a working face above the table extending adjacent the power tool cutter to define a longitudinal feed axis, the main fence body including screw holes therethrough extending perpendicular to the working face;

a sliding face assembly having an out-feed section mounted to the main fence body comprising of inner and outer wedge-shaped ramps which are movable with respect to one another along the longitudinal feed axis and adapted to be locked together, thus allowing slow and precise advancement of the outer ramp relative to the inner wedge-ramp which results in moving an outfeed section of the working face of the sliding face assembly toward the operator, the inner wedge-ramp being secured to the main fence body with elongated locking screws that extend through the screw holes in the main fence body and the outer wedge-ramp being secured to the main fence body with elongated locking screws that extend through the screw holes in the main fence body as well as holes in the inner wedge-ramp; and a powered feeder element adapted to mount on the main fence body having a motor and drive shaft terminating in a roller suspended over the table adjacent the working face, the powered feeder element having fence mounting structure including a base assembly configured to rigidly mount on top of the main fence body such that the drive shaft is suspended at a downward angle above and beyond the working face, the fence mounting structure configured to position the roller in contact with the workpiece and the powered feeder element configured to rotate the roller so as to propel the workpiece on the table over the power tool cutter and along the working face in the direction of the longitudinal feed axis.

11. The system of claim 10, wherein the roller has a conical shape to enable the pressure and motion to be applied to the workpiece adjacent the intersection of main fence body and table.

12. The system of claim 10, wherein the roller is an elastomer.

13. The system of claim 10, wherein the fence mounting structure of the powered feeder element includes an adjustable carriage for longitudinal feed axis travel along the fence.

14. The system of claim 10, wherein the fence mounting structure of the powered feeder element includes a rotary adjustment in the base assembly permitting rotation about a vertical axis where the table is in a horizontal axis.

15. The system of claim 10, wherein the powered feeder element has a reversible gear motor to enable rotation of the roller to propel the workpiece on the table in the both directions along the longitudinal feed axis.

16. The system of claim 10, wherein the sliding face assembly further includes sacrificial contact faces secured to the working face of the main fence body so as to be easily removed or replaced.

17. The system of claim 10, wherein the inner and outer wedge-shaped ramps are adapted to be locked together with knobs on the respective elongated locking screws located on a face of the fence opposite the working face.

18. The system of claim 10, further including a ramp adjustment bracket attached to the outer ramp and provided with an adjustment screw which threads into the end of inner ramp, thus allowing slow and precise advancement of the outer ramp with respect to the inner ramp.

19. The system of claim 10, further including a pressure lever arm mounted to pivot about a horizontal axis on the base assembly and from which the motor and shaft are suspended, and a spring engaged between the pressure lever arm and the base assembly that translates into downward force to the inverted roller against the workpiece.

* * * * *